US007711278B2

(12) United States Patent
Sakata

(10) Patent No.: US 7,711,278 B2
(45) Date of Patent: May 4, 2010

(54) IMAGE FORMING APPARATUS

(75) Inventor: Shiro Sakata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 521 days.

(21) Appl. No.: 11/683,073

(22) Filed: Mar. 7, 2007

(65) Prior Publication Data

US 2007/0212087 A1 Sep. 13, 2007

(30) Foreign Application Priority Data

Mar. 8, 2006 (JP) ..... 2006-062531
Feb. 23, 2007 (JP) ..... 2007-044007

(51) Int. Cl.
*G03G 15/02* (2006.01)

(52) U.S. Cl. ..... 399/50; 399/89; 399/128

(58) Field of Classification Search ..... 399/38, 399/50, 89, 128
See application file for complete search history.

(56) References Cited

U.S. PATENT DOCUMENTS 5,636,009 A 6/1997 Honda et al. ..... 399/50
5,771,422 A * 6/1998 Morihara ..... 399/50
6,332,064 B1 * 12/2001 Sato et al. ..... 399/50
2005/0271406 A1 * 12/2005 Okano et al. ..... 399/50

FOREIGN PATENT DOCUMENTS

JP 3397339 11/1993
JP 06236131 A * 8/1994

* cited by examiner

*Primary Examiner*—David P Porta
*Assistant Examiner*—Benjamin Schmitt
(74) *Attorney, Agent, or Firm*—Fitzpatrick, Cella, Harper & Scinto

(57) ABSTRACT

In an image forming apparatus in which a DC bias is applied to charge a photosensitive drum, when a charge eliminating device is in deterioration or failure, there are some cases where a proper charging is not made, and thus poor imaging occurs. A DC bias is applied to a charging member in the charge eliminating operation area of an image bearing member where the charge eliminating device makes charge eliminating operation; and based on the values of an electric current passing through the image bearing member on that occasion, a DC bias application is switched between by constant-current-control and by constant-voltage-control.

5 Claims, 13 Drawing Sheets

| FIG. 6A |
| --- |
| FIG. 6B |

IMAGE FORMING APPARATUS

BACKGROUND OF THE INVENTION

1. Field of the Invention

The present invention relates to an image forming apparatus of an electrophotographic printing method and the like.

2. Description of the Related Art

A printer will be described as an example among image forming apparatuses.

As a method of charging an image bearing member of an image forming apparatus with a charging member, such as a charging roller, a DC charging bias is applied to the charging roller by a constant-current-control. By making constant-current-control, good charging can be made without being affected by fluctuations in the impedance of the charging roller or environmental fluctuations.

FIG. 12 illustrates a schematic arrangement of a conventional charging bias application circuit 1301. A voltage setting circuit portion 1302 changes a set value in response to a PWM signal. The charging bias application circuit 1301 includes a transformer driving circuit portion 1303 and a high voltage transformer 1304. A feedback circuit portion 1305 converts the value of an electric current I162 passing through a charging roller (a charging member) 106 to a voltage with a resistor R161 for detection, and transmits this voltage to an engine controlling portion as an analog value from J501. Then, based on this analog value, the engine controlling portion sets a PWM signal so as to be a required electric current value. Making a series of control in such an arrangement can pass a constant electric current value through the charging roller. Application of such an embodiment is made in Japanese Patent No. 3397339. Like this, by applying a DC charging bias by constant-current-control, images of a constant density, without being affected by fluctuations in impedance of a charging roller or environmental fluctuations, can be obtained.

When applying a DC charging bias by constant-current-control, if remaining electric potential is left on an image bearing member, an electric potential difference is decreased between a charging member and the image bearing member, and an electric current is less likely to pass. By making constant-current-control in such situations, the electric potential of the charging member 106 will be set to be excessively high, and thus the electric potential of the image bearing member to be charged will be higher as well, eventually causing poor imaging. Therefore, as to the remaining electric potential, an electric charge needs to be eliminated using an optical element (charge eliminating device) such as an LED to reduce an electric potential. Thus, this charge eliminating process needs to be inserted in sequence. However, in the case of the occurrence of deterioration, contamination or breakdown in the charge eliminating device, applying a DC charging bias by constant-current-control as it is may cause poor imaging.

This deterioration or the like of the charge eliminating device may not be found even if an electric current passing through the charge eliminating device is detected. For example, when a charge eliminating device is an optical element, the surface of the optical element may be contaminated with toner. In this case, in spite of the same electric current as in the normal state passing through the optical element, a sufficient exposure cannot be made onto an image bearing member, resulting in the occurrence of charging failure, and thus poor imaging.

SUMMARY OF THE INVENTION

According to the present invention, an optimum control of a charging bias can be made based on operation situations of a charge eliminating device. Alternatively, operation situations of the charge eliminating device can be informed to the outside.

Further features of the present invention will become apparent from the following description of exemplary embodiments with reference to the attached drawings.

DESCRIPTION OF THE EMBODIMENTS

Figure 1:
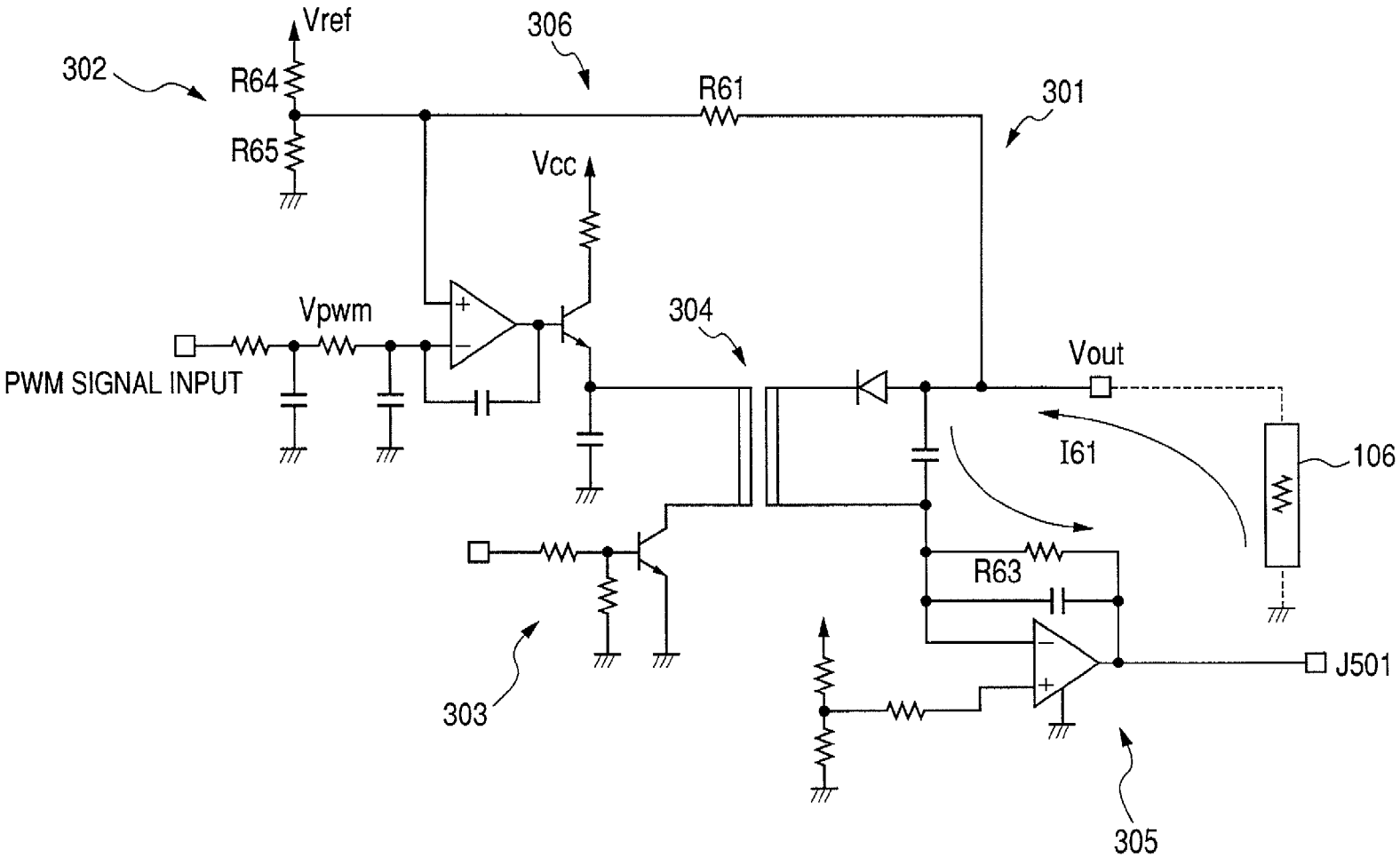
FIG. 1 illustrates a charging bias circuit arrangement according to a first embodiment of the present invention.

Hereinafter, embodiments according to the present invention will be described referring to the drawings.

First Embodiment

Figure 7:
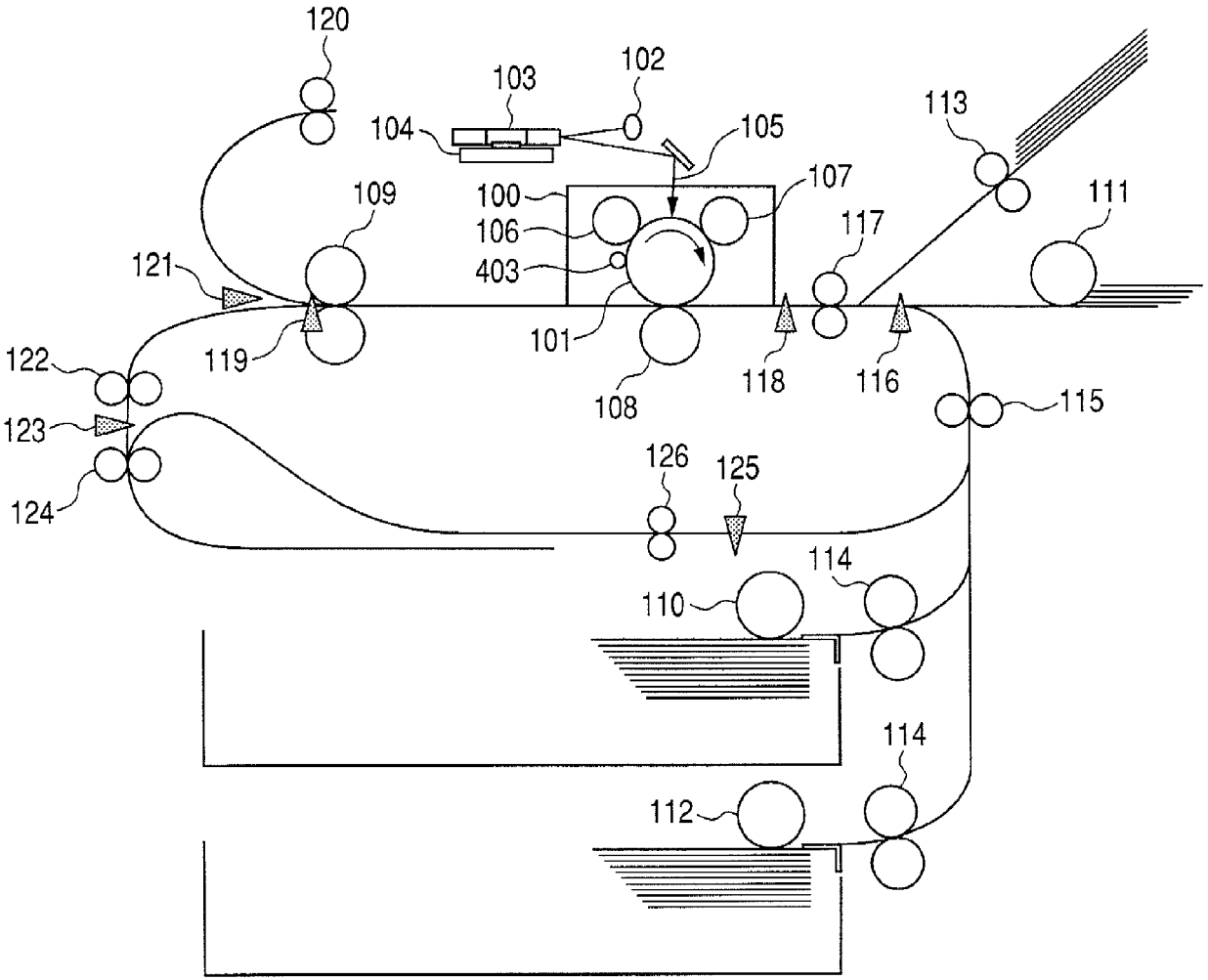
FIG. 7 is a schematic diagram of an image recording apparatus main body construction according to the present invention.

A printer will be described as an example among image forming apparatuses. The printer has such a construction as illustrated in FIG. 7. In FIG. 7, the printer includes a photosensitive drum 101 acting as an image bearing member, a semiconductor laser 102 acting as a light source, and a rotary polygon mirror 103 rotated by a scanner motor 104. A laser beam 105 output from the semiconductor laser 102, scans and exposes the photosensitive drum 101.

A charging roller 106 is a charging member for uniformly charging the photosensitive drum 101. A developing device 107 develops with a toner an electrostatic latent image formed on the photosensitive drum 101. A transfer roller 108 transfers a toner image having been developed with the developing device 107 onto a predetermined recording sheet. A fixing roller 109 fixes with heat toner that has been transferred to the recording sheet. An optical element 403 is a charge eliminating device eliminating an electric charge of the photosensitive drum 101.

A cassette feed roller 110 feeds sheets to feeding and conveying paths from a cassette. A manual feed roller 111 feeds sheets to a conveying path from a manual paper feed port. An option cassette feed roller 112 feeds sheets to conveying paths from a removable cassette. An envelope feeder feed roller 113 singly feeds sheets to conveying paths from an envelope feeder, which is removable, and on which only envelopes can be stacked. Conveying rollers 114 and 115 convey sheets having been fed from the cassettes.

A pre-feed sensor 116 detects a leading edge and a trailing edge of a sheet fed from other than the enveloper feeder. An ante-transfer roller 117 feeds sheets having been conveyed to the photosensitive drum 101. A top sensor 118, with respect to sheets having been fed, takes synchronization of image writing (recording/printing) onto the photosensitive drum 101 and sheet conveyance, as well as measures the length in a conveying direction of sheets having been fed. A sheet discharge sensor 119 detects the presence or absence of sheets after fixing. A discharge roller 120 discharges the sheets having been fixed to the outside of the apparatus.

A flapper 121 switches the conveying destination of printed sheets (between being discharged outside of an apparatus, or to a removable duplex unit). A conveying roller 122 conveys to the reversing portion sheets having been conveyed to the duplex unit. A reversing sensor 123 detects the leading edge/trailing edge of the sheets having been conveyed to the reversing portion. A reversing roller 124 reverses sheets by making a sequential operation of forward rotation/reverse rotation, and conveys the sheets to a sheet re-feeding portion. A sheet re-feeding sensor 125 detects the presence or absence of sheets at the sheet re-feeding portion. A sheet re-feeding roller 126 feeds the sheets at the sheet re-feeding portion to a conveying path again.

Figure 8:
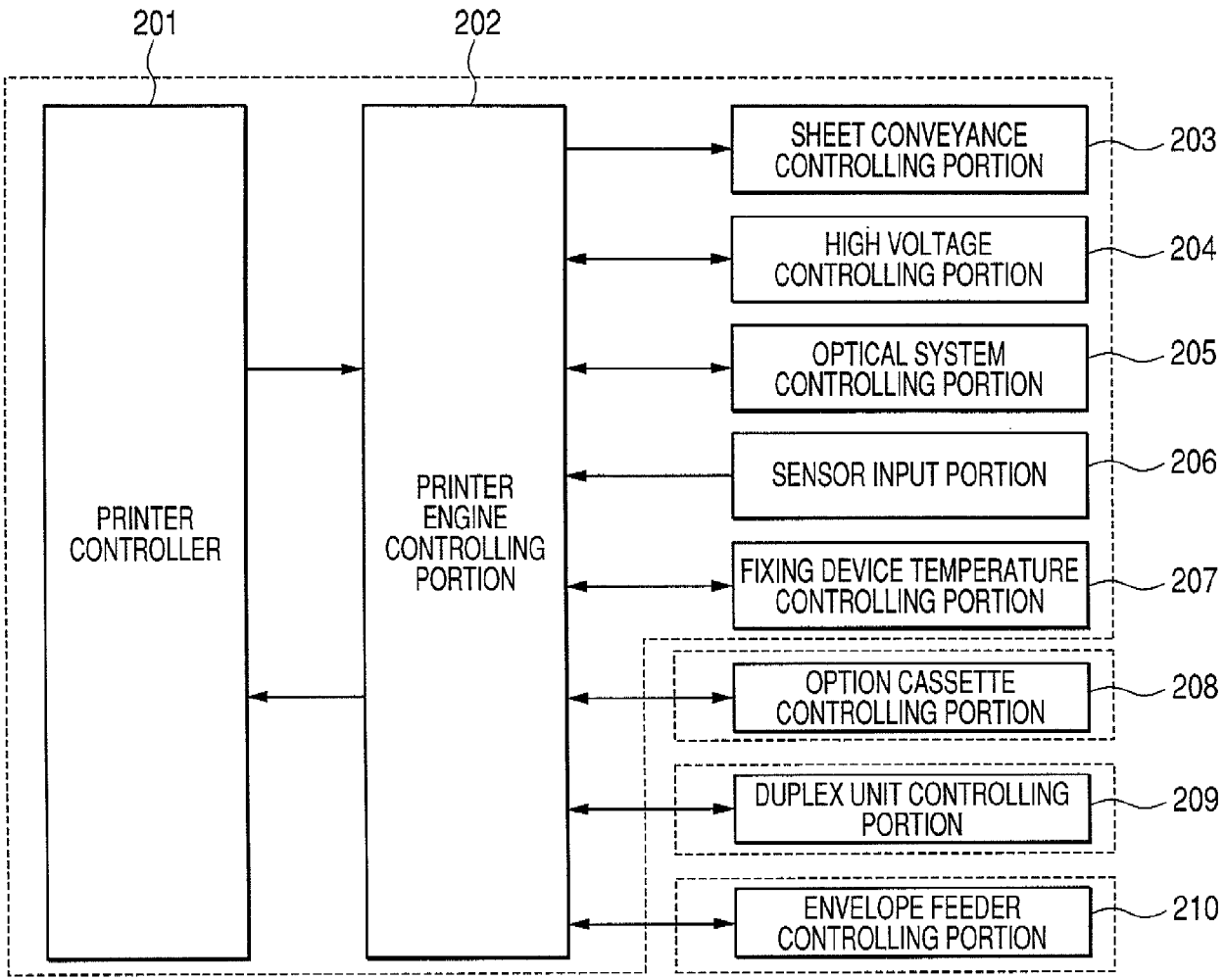
FIG. 8 is a schematic diagram of an image recording apparatus controller portion according to the present invention.

A circuit arrangement block diagram of a control system for controlling such a mechanism portion is illustrated in FIG. 8. With reference to FIG. 8, a printer controller 201 develops an image code data to be transmitted from an external device (not shown), such as host computers, into bit data necessary for printing by a printer. Furthermore, the printer controller 201 reads information in the printer, and indicates them. A printer engine controlling portion 202 controls operations of each portion of a printer engine based on commands from the printer controller 201. In addition, the printer engine controlling portion 202 informs the printer controller 201 of information in the printer. A sheet conveyance controlling portion 203 makes driving/stop of motors, rollers and the like for conveying recording sheets based on commands from the printer engine controlling portion 202. A high voltage controlling portion 204 controls each output at a high voltage during each process of charging, development, transfer or the like based on commands from the printer engine controlling portion 202. An optical system controlling portion 205 controls driving/stop of the scanner motor 104 and lighting of a laser beam based on commands from the printer engine controlling portion 202. The printer engine controlling portion 202 receives signals from a sensor input portion 206. A fixing device temperature controlling portion 207 adjusts the temperature of a fixing device to the temperature determined by the printer engine controlling portion 202.

A removable option cassette controlling portion 208 makes driving/stop of a driving system based on commands from the printer engine controlling portion 202, as well as informs the printer engine controlling portion 202 of the present or absent state of sheets, and sheet size information.

A removable duplex unit controlling portion 209 reverses sheets and makes sheet re-feeding operations based on the commands from the printer engine controlling portion 202, as well as informs the printer engine controlling portion 202 of the operation state thereof.

A removable envelope feeder controlling portion 210 makes driving/stop of a driving system based on commands from the printer engine controlling portion 202, as well as informs the printer engine controlling portion 202 of the present or absent state of sheets.

Image forming operations will be described. The photosensitive drum 101 is rotated in the direction indicated by an arrow in FIG. 7. The photosensitive drum 101 is charged by the charging roller 106 in the charging process. In the charging process, the area of the photosensitive drum 101 on which charge has been eliminated by the below-described optical element 403, is charged. The charged photosensitive drum 101 is formed with an electrostatic latent image corresponding to an image data with the semiconductor laser 102 in the latent image forming process. In the development process, the electrostatic latent image is developed into a toner image by the developing device 7. In the transfer process, the developed toner image is transferred to a predetermined recording sheet by the transfer roller 108. After the transfer process, a cleaning unit (not shown) collects toner on the photosensitive drum 101. Then, the remaining electric potential is eliminated by the optical element 403. The toner image having been transferred to the recording sheet, is then fixed to the recording sheet by the fixing rollers 109.

Features of an image forming apparatus according to this embodiment will be described briefly. A charging roller acting as a charging member is supplied with a DC voltage to charge a photosensitive drum, which is an image bearing member. The DC voltage is generated by a constant voltage power supply. The DC voltage is applied by constant-current-control in which an electric current value passing through the charging roller, at the time of output from the constant voltage power supply, and the value of the constant voltage power supply are controlled so that the electric current value thereof is a predetermined value. In the case of such constant-current-control, when an electric potential remains on the photosensitive drum before charging, there are some instances in which the photosensitive drum cannot be charged at an optimum electric potential. Herein, the remaining electric potential means that the electric potential of the photosensitive drum 101 remains at a high electric potential before the charging process. For example, suppose that the charging process, the latent image forming process, the developing process and the transfer process have been practiced. In the latent image forming process, the portion of the photosensitive drum 101 not exposed to the semiconductor laser 102, and been charged by the charging roller 106, has an electric potential which has not been eliminated sufficiently, and charging is conducted again with a high electric potential left.

Accordingly, when an image is formed (when a process unit makes processing of the area on an image bearing member on which an image is formed), an electric charge is eliminated with a charge eliminating device using an optical element, and the remaining electric potential of the image bearing member is erased, then charging is performed. For example, there is disposed an optical element 403 (charge eliminating device) on the upstream side of the charging roller 106 in the rotation direction of the photosensitive drum 101, and the photosensitive drum 101 is exposed with the optical element 403, to erase the remaining electric potential.

In the case, however, where a charge eliminating device is not normally operated due to e.g., deterioration or failure, there will be no proper charging. Thus, to detect whether or not a charge eliminating device is in failure, the following operations are made at the time of non-image formation. The photosensitive drum has preliminarily been charged by a charging roller, and the electric charge, at this portion having been charged, is eliminated with the charge eliminating device. A DC bias is applied to the charging member at the charge eliminating operation area on the image bearing member, where the charge eliminating device has been operated, and the electric current passing thorough the charging member is detected. The operational state of an optical element (e.g., in normal state, in deterioration, or in failure is) determined based on the detected electrical current values. Based on the determination results, the DC bias to be applied to the charging member at the time of image formation is switched between constant-current-control and constant-voltage-control. Here, the reasons why it is possible to determine whether an optical element is normal or deteriorated based on the electric current value passing through the charging roller will be described. When the optical element is normally operated, the remaining electric potential on an image bearing member is eliminated, and a sufficient electric potential difference is formed between the charging roller and the photosensitive drum. Thus, an electric current is likely to pass. Whereas, when the optical element is not operated normally due to deterioration, contamination or the like, the remaining electric potential on the image bearing member cannot be eliminated sufficiently. Thus, no sufficient electric potential difference is formed between the charging roller and the photosensitive drum. Therefore, the electric current does not pass as much as when the remaining electric potential is eliminated. Accordingly, the determination of whether the optical element is normal or not can be determined by detecting electric currents passing through the charging roller.

FIG. 1 shows a schematic arrangement of a charging bias application circuit 301 according to the first embodiment of the present invention.

A voltage setting circuit portion 302 changes a voltage value to be applied to the charging roller 106 in response to a PWM signal. The charging bias application circuit 301 includes a transformer driving circuit portion 303 and a high voltage transformer 304. An electric current detecting circuit portion 305 converts an electric current value 161 passing through the charging roller 106 to a voltage with a resistor R63 for detection, and transmits this voltage as an analog value from J501 to an engine controlling portion. Then, based on this analog value, the engine controlling portion sets a PWM signal so as to be a required electric current value. Making a series of control in such arrangement can pass a constant electric current value through the charging roller 106. A feedback circuit 306 performs a constant-voltage-control. For the constant-voltage-control, a predetermined PWM input signal is fixedly set to keep the voltage to be applied to the charging roller 106 constant.

Figure 2:
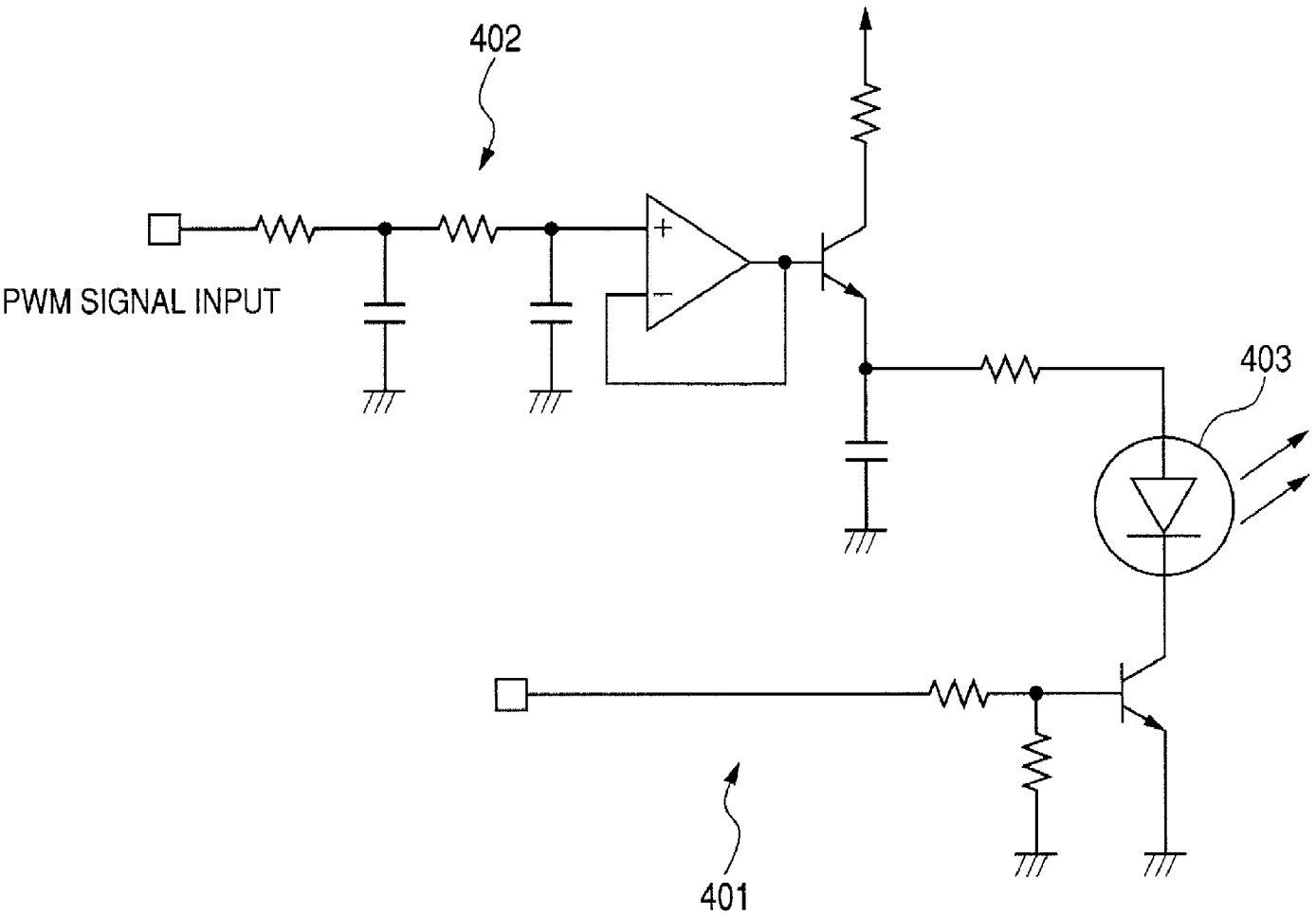
FIG. 2 illustrates an optical element circuit arrangement according to the first embodiment of the present invention.

In addition, FIG. 2 shows a schematic arrangement of an optical element electric current setting circuit in the first embodiment of the present invention.

An optical element driving circuit 401 turns ON/OFF of light emission in response to control signals in a driving circuit of the optical element 403. A voltage setting circuit portion 402 changes setting values in response to PWM signals, and can change the value of an electric current passing through the optical element.

Figure 9:
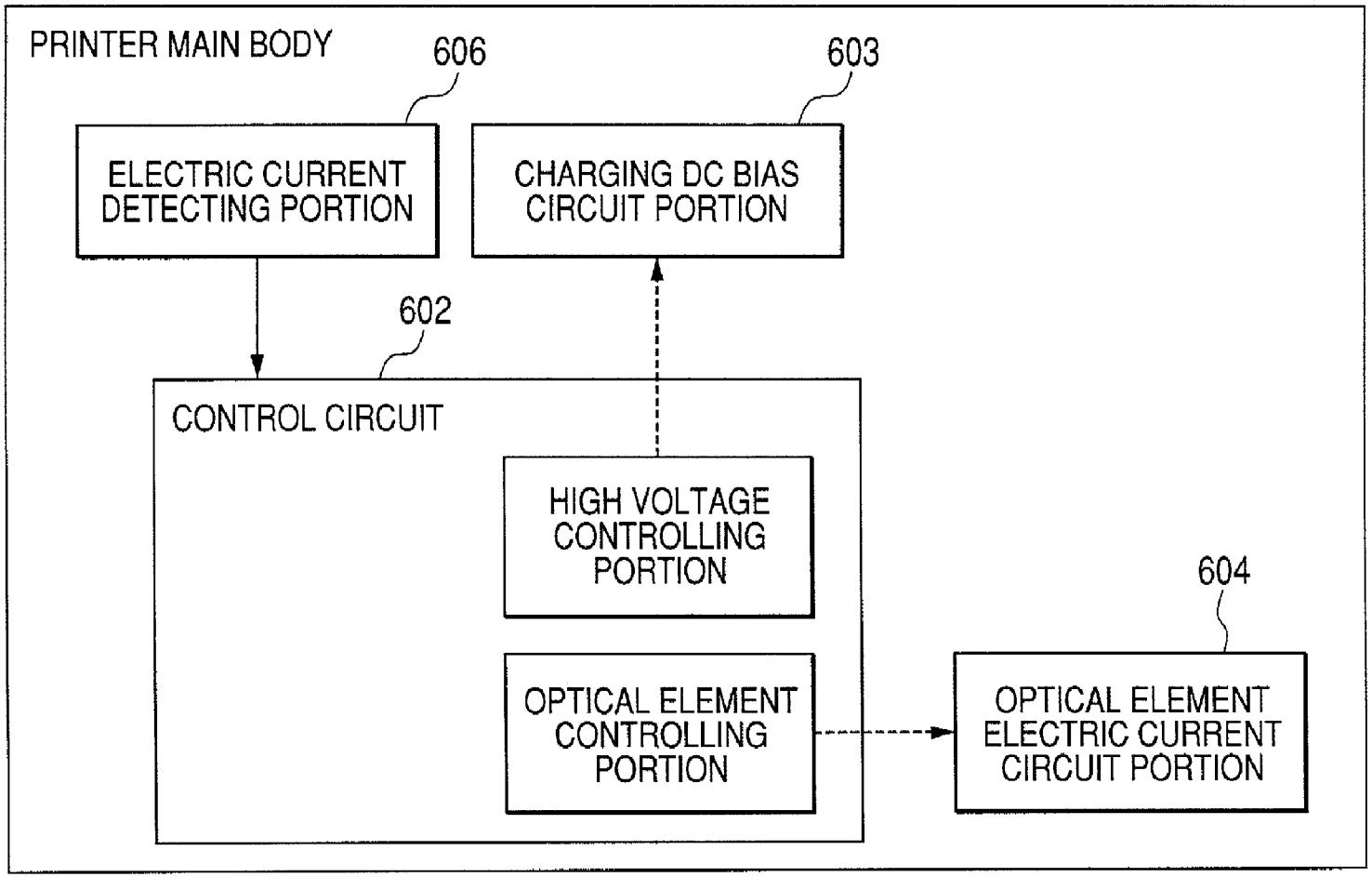
FIG. 9 is a schematic diagram of a control portion according to the first embodiment of the present invention.

FIG. 9 is a schematic diagram of a control mechanism. There are provided at a printer main body a control circuit (control portion) 602, a charging bias application unit (charging DC bias circuit portion) 603, an optical element electric current setting unit (optical element electric current circuit portion) 604, an electric current detecting portion (electric current detecting circuit) 606 for detecting an electric current passing between the charging roller and the photosensitive drum, and a control circuit 602. The control circuit 602 is provided with a high voltage controlling portion and an optical element controlling portion. These portions control the charging DC bias circuit portion 603 and the optical element electric current circuit portion 604 respectively.

Figure 3:
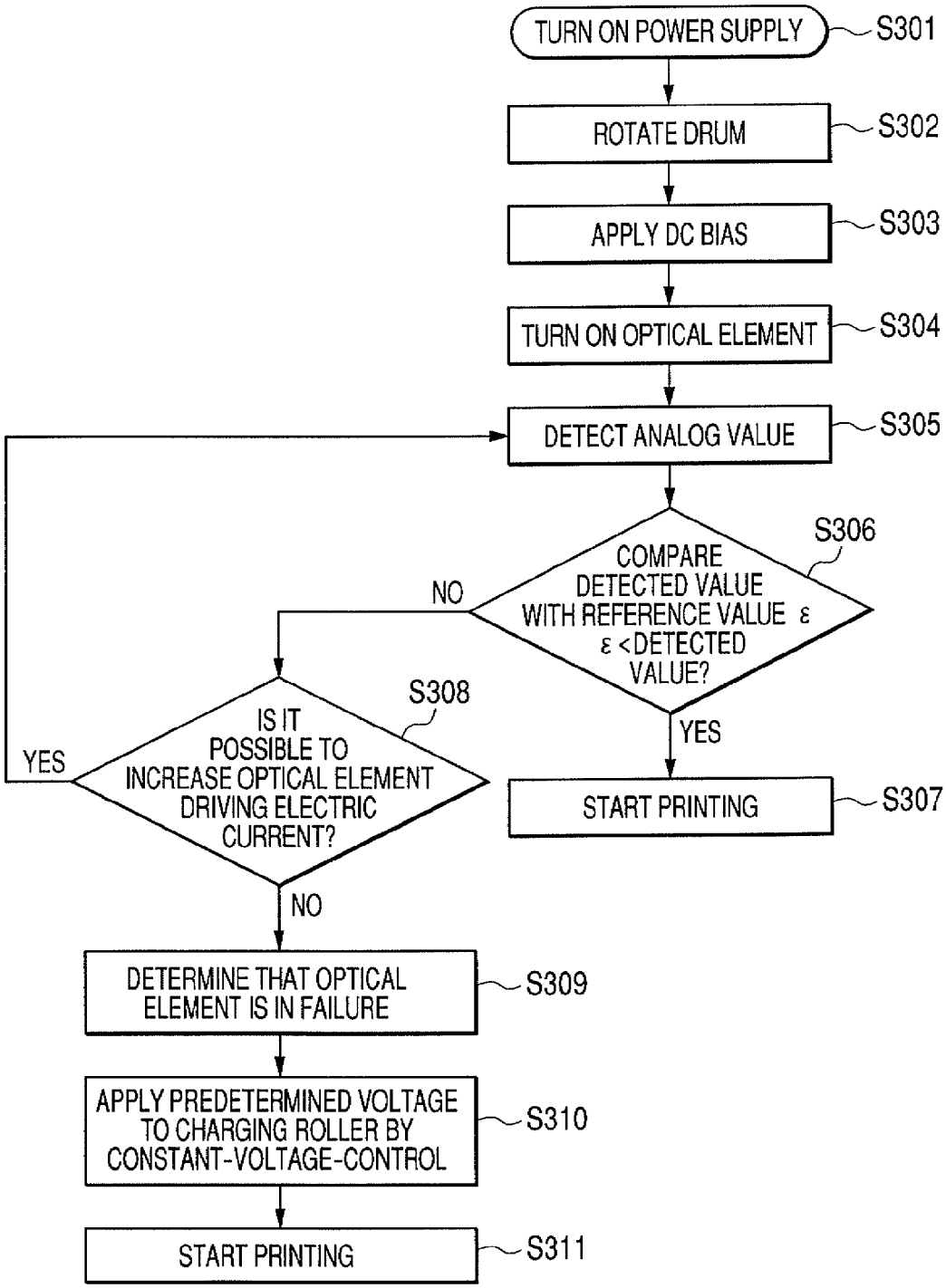
FIG. 3 is a flowchart according to the first embodiment of the present invention.

The control circuit 602 controls the charging DC bias circuit portion 603 and the optical element electric current circuit portion 604 in sequence of a flow chart as described below. The flowchart according to this embodiment is shown in FIG. 3.

First, a power supply of an image forming apparatus is turned on (S301). When started a previous rotation, being a preparation operation to be done immediately after the power supply of the image forming apparatus has been turned on, or the previous rotation, being a preparation operation before image formation, the photosensitive drum begins to rotate (S302). Then, after the photosensitive drum has been charged, an optical element is turned on to eliminate the electric charge of the photosensitive drum, and then a DC bias is applied by constant-voltage-control to the charging roller in the charge eliminating operation area of the photosensitive drum. The voltage to be applied at that time is such a voltage value as a discharge electric current reliably passes between the drum and the charging roller (S303) (S304). The charge eliminating operation area is the area where the electric charge on the photosensitive drum is eliminated supposing that a charge eliminating device (optical element) is normally operated. Further, the charge eliminating operation area means the area where although the electric potential on the photosensitive drum is not eliminated in the case of the occurrence of malfunctions such as failures of a charge eliminating device, the electric charge should have been eliminated. In this state, the value of an electric current passing through the charging roller is detected from an analog value of J501 (S305). A detected value of the electric current thereof is compared with a reference value $\epsilon$ (first value) (S306). Moreover, because an electric current passing through the photosensitive drum from the charging roller in the case of a photosensitive drum negatively charged is a negative electric current, a reference value is a negative value. Between a detected value and a reference value, comparison of the magnitude of respective absolute values is made. In the case of a reference value $\epsilon$<a detected value, sufficient charge elimination has been done, and an optical element is determined to have no problem. Thus, a series of printing operations is started (S307). In the case of a reference value $\epsilon \geqq$a detected value, charge elimination has not been done sufficiently, and an optical element is determined to be deteriorated or contaminated. Then, with a PWM signal setting the driving electric current of the optical element, the driving electric current is increased, and thus the amount of light of the optical element is increased (S308). Subsequently, an analog value of J501 is calculated again, and the same routine is repeated until a level of charge elimination is sufficient. In this routine operation, the driving electric current having been set at a time point of exceeding the reference value $\epsilon$ is recorded, and set to be the driving electric current of the optical element for printing, thus starting the printing operation (S307). In the case of not exceeding the reference value $\epsilon$ even at setting of the maximum driving electric current in this routine operation, the optical element is determined to be in failure (S309). In the charging bias application circuit, the voltage which does not cause poor imaging is set to be applied to the charging roller by constant-voltage-control (S310), and then the printing operation is started (S311).

By performing such control, constant-current-control can be performed when an optical element is normally operated; and constant-voltage-control can be performed in the case where an optical element is not operated normally. Constant-current-control may be performed when an optical element is operated; and constant-voltage-control may be performed when an optical element is not operated. When performing DC constant-current-control without exposure, an excess voltage will be applied, thus printing a defective image. Like this, good charging based on operation situations of an optical element can be made, thus enabling to form images of high quality.

Second Embodiment

According to this embodiment, there is a plurality of reference values to be compared with detected electric currents, and a control of increasing an optical element driving electric current is performed on the basis of a relationship between the detected value and the reference value. Also, on the basis of the relationship between the detected value and the reference value, the DC bias control of a charging roller is switched from being applied by constant-current-control to being applied by constant-voltage-control. The schematic arrangement of a charging bias application circuit and the schematic arrangement of an optical element electric current setting circuit in the second embodiment according to the present invention are the same as those in the first embodiment, thus to be omitted.

Figure 4:
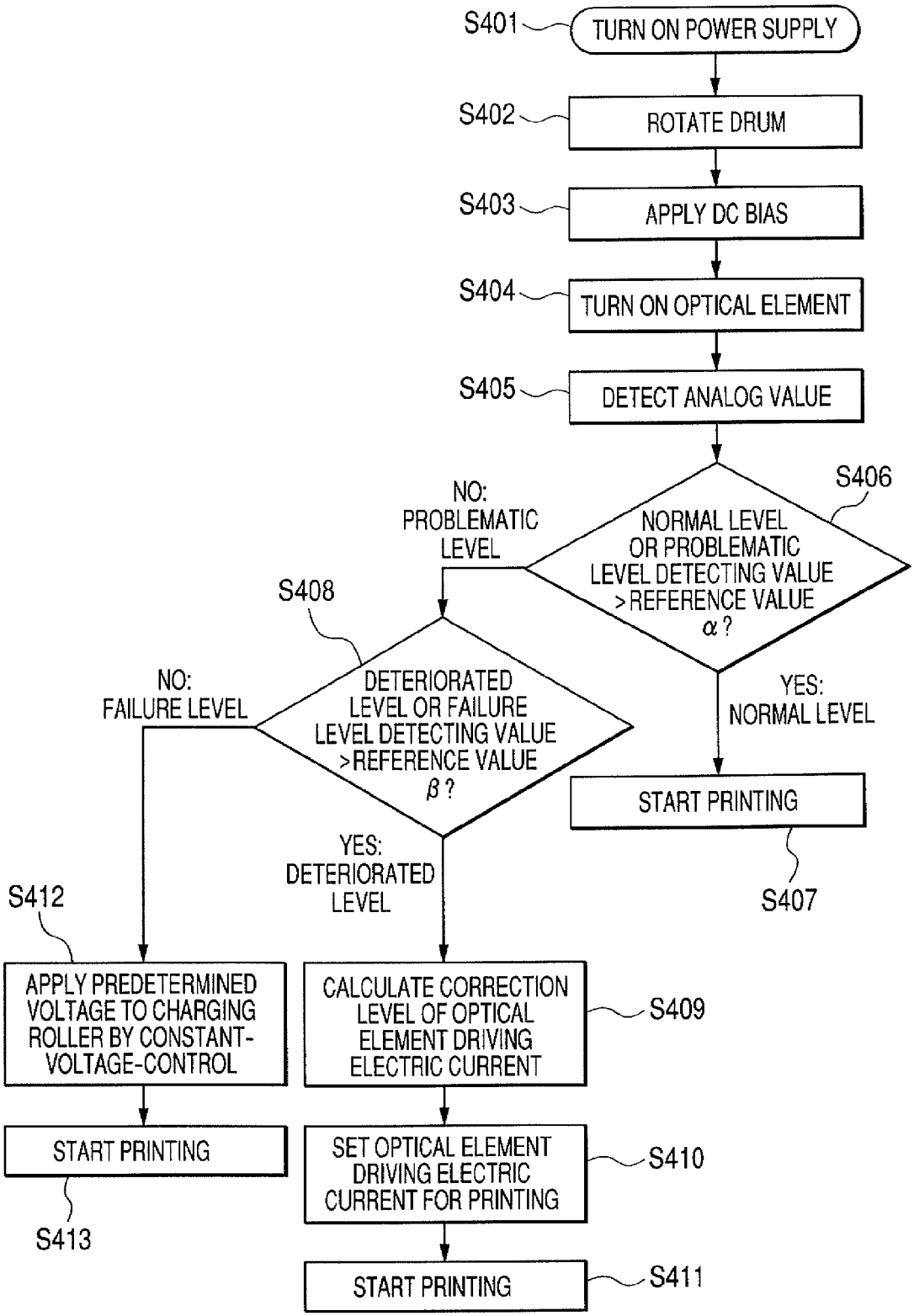
FIG. 4 is a flowchart according to a second embodiment of the present invention.

A flowchart of this embodiment is shown in FIG. 4.

A power supply of an image forming apparatus is turned on (S401). When multiple pre-rotation, being a preparatory operation to be done immediately after the power supply has been turned on, or pre-rotation, being a preparatory operation before image formation is started, the photosensitive drum begins to rotate (S402). Then, after the photosensitive drum has been charged, an optical element is turned on to eliminate the electric charge on the photosensitive drum, and then a DC bias is applied by constant-voltage-control to the charging roller in the charge eliminating operation area of the photosensitive drum (S403)(S404). The charge eliminating operation area is the area where the electric charge on the photosensitive drum is eliminated supposing that a charge eliminating device is operated. Further, the charge eliminating area refers to the area where although the electric charge on the photosensitive drum is not eliminated in the case of the occurrence of malfunctions such as failures of a charge eliminating device, the electric charge should have been eliminated. In this state, the value of an electric current passing through the charging roller is detected from an analog value of J501 (S405). The detected value thereof is compared with a reference value $\alpha$ (second value) (S406). In the case of a reference value $\alpha$<a detected value, sufficient charge elimination is done, and an optical element is determined to have no problem. Then a series of printing operations is started (S407). In the case of a reference value $\alpha \leqq$a detected value, the detected value is compared with a reference value $\beta$ (first value) (S408). In the case of the reference value $\beta$<a detected value, an optical element is determined to be deteriorated or contaminated, and a correction level of a PWM value is calculated (S409). The calculated value thereof is set to be a driving electric current of an optical element (S410), and a printing operation is started (S411). The correction of a PWM value to be done in S409 is made so that a homopolar bias of an absolute value larger than that of the bias applied to the optical element when the reference value $\alpha$<a detected value. Accordingly, a control of increasing the optical element driving electric current is performed. That is, when the reference value $\beta$<a detected value$\leqq$a reference value $\alpha$, a bias to be applied to the optical element (first bias) is made larger. Furthermore, when the reference value $\alpha$<a detected value, a bias to be applied to the optical element (second bias) is set to be a smaller bias than the first bias. In the case of the reference value $\beta \geqq$a detected value, the optical element is determined to be in failure (S408), and the voltage which does not cause poor imaging is applied to the charging roller by constant-voltage-control (S412), and then printing operation is started (S413). Moreover, since an electric current passing through the photosensitive drum from the charging roller in the case of a photosensitive drum negatively charged is a negative electric current, the reference values $\alpha$ and $\beta$ are negative values. The magnitudinal correlation between the reference value $\alpha$ and the reference value $\beta$ is the reference value $\alpha$>the reference value $\beta$ in respect of an absolute value. Between a detected value and a reference value, comparison of the magnitude of respective absolute values is performed.

By performing such control, constant-current-control can be performed when an optical element is normally operated. Furthermore, when an optical element is deteriorated or contaminated, a driving electric current of the optical element is corrected, and a bias to be applied to the optical element is made larger than that at the normal time. Whereby a sufficient charge elimination is reliably made, and thus a constant-current-control can be performed. Furthermore, when the optical element is not operated normally, constant-voltage-control can be performed, by making control depend on the operational situation of the optical element, good charging can be made, thus enabling images of high quality.

Third Embodiment

Figure 11:
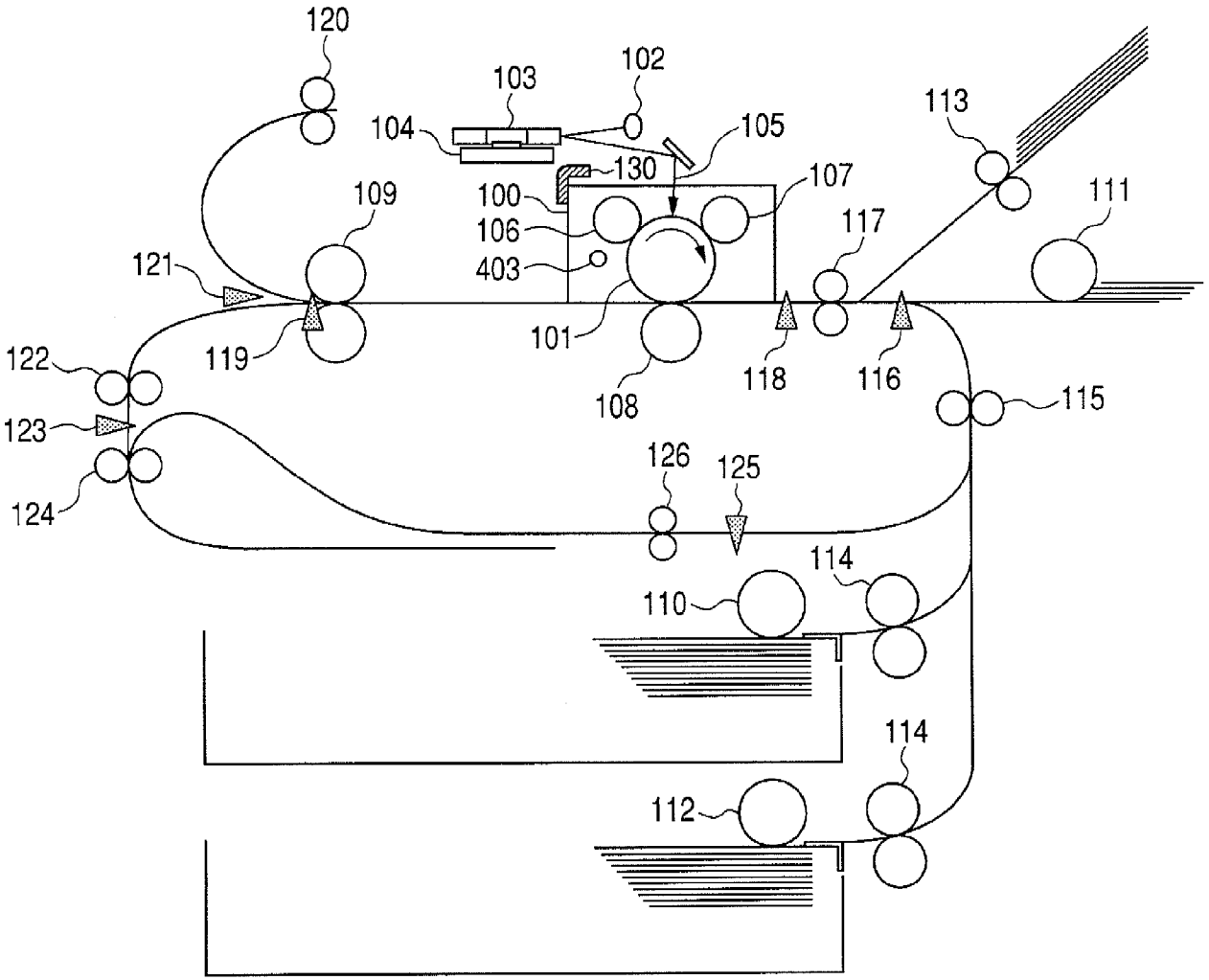
FIG. 11 is a schematic diagram of an image recording apparatus main body construction according to the third embodiment of the present invention.
Figure 12:
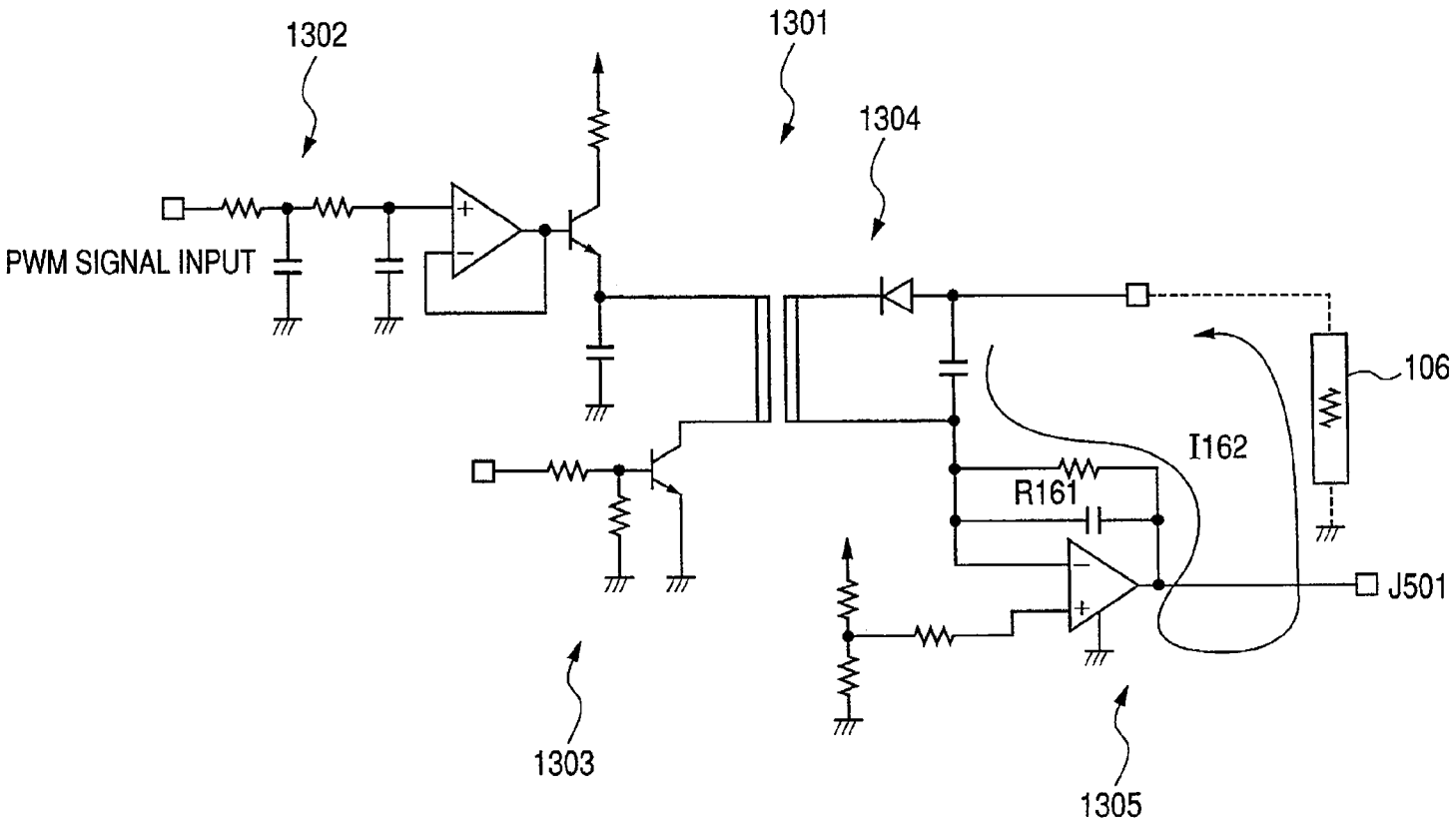
PRIOR ART FIG. 12
FIG. 12 is a view of illustrating a conventional charging bias circuit arrangement.

In this embodiment, depending on the condition of use of a process cartridge removable with respect to an image forming apparatus main body, a driving electric current to be applied to an optical element and a voltage to be applied to a charging roller when detecting operational states of the optical element are changed. Herein, the process cartridge refers to the one which is formed of an integral structure of at least an image bearing member and a process unit, and which is removable with respect to an image forming apparatus main body (an image forming apparatus portion excluding a process cartridge). In this embodiment, as illustrated in FIG. 11, a photosensitive drum 101, a charging roller 106, and a developing device 107 form a process cartridge as an integral structure. There is provided in the image forming apparatus main body a mounting unit 130, thus enabling to mount the process cartridge.

In a charging roller, the film thickness of a charging layer comes to be smaller by repeating image formation, and thus an electric current value required for charging the photosensitive drum becomes larger. As the value of an electric current to be applied to the drum is increased, the amount of an electric charge accumulated at the drum is increased. Accompanied thereby, the amount of light of the optical element performing charge elimination has to increase. In this respect, advantages of this embodiment can be found.

Figure 5:
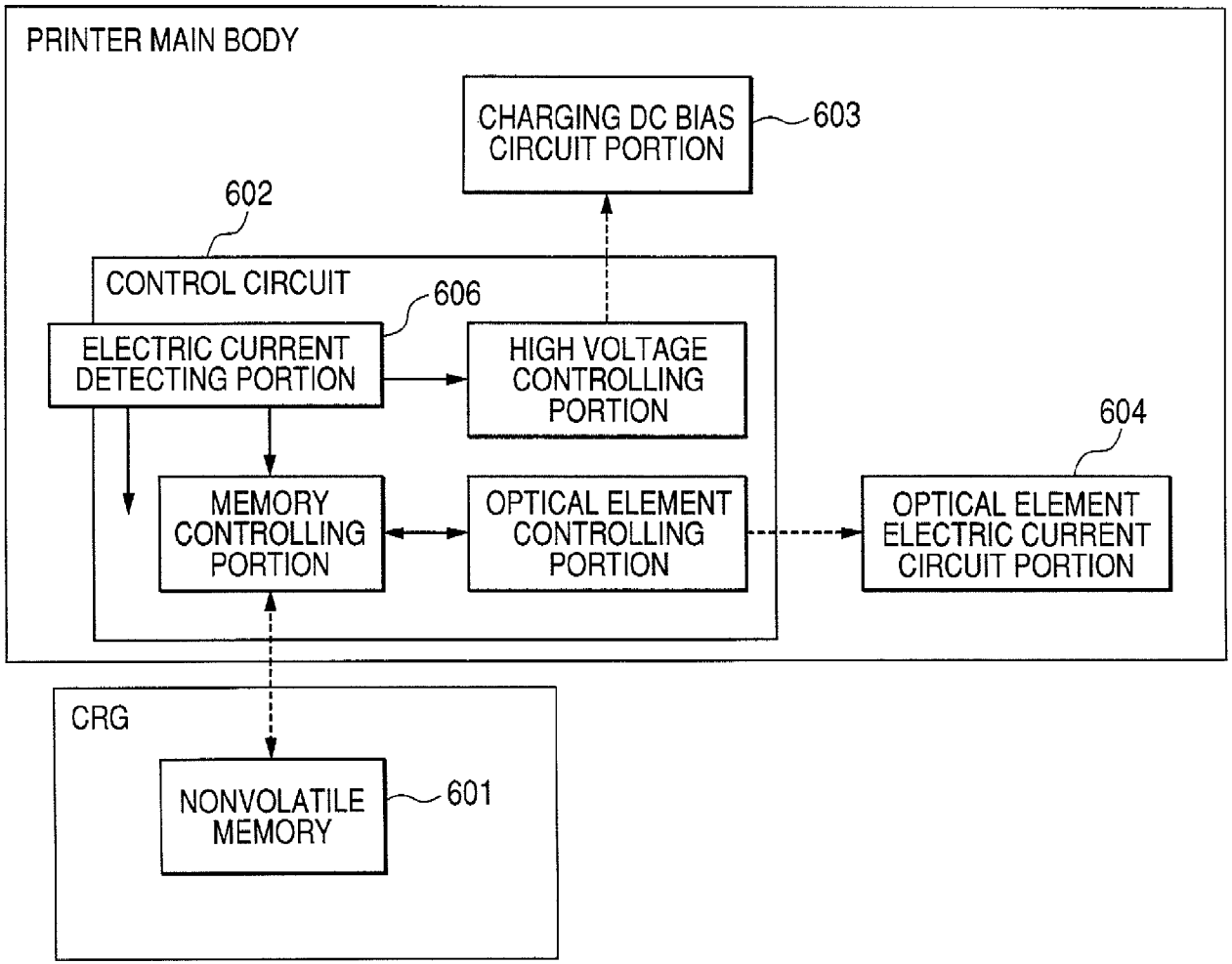
FIG. 5 is a communication schematic diagram of a non-volatile memory according to a third embodiment of the present invention.

The schematic arrangement of a charging bias application circuit and the schematic arrangement of an optical element electric current setting circuit in the third embodiment according to the present invention are the same as those in the first embodiment, thus to be omitted. FIG. 5 illustrates a communication mode of the third embodiment according to the present invention. In FIG. 5, a nonvolatile memory 601 acting as a storage medium stores conditions of use (values of used amount) of a process cartridge (hereinafter referred to as a CRG). The used amount of CRG is detected by a known used amount-detecting unit e.g., counting the total number of revolutions of an image bearing member. A control circuit (control portion) 602 makes communication with the nonvolatile memory 601, detects the used amount of a mounted CRG, and transmits signals based on these detected values to a charging bias application unit or an optical element electric current setting unit. That is, the bias value to be applied to the charging roller or the electric current value to be applied to the optical element is changed depending on the used amount of CRG. The control circuit 602 is provided with a high voltage controlling portion and an optical element controlling portion, which control a charging DC bias circuit portion (charging DC bias circuit portion) 603 and an optical element electric current circuit portion (optical element electric current circuit portion) 604 respectively. An electric current detecting portion (electric current detecting circuit) 606 detects an electric current passing between the charging roller and the photosensitive drum.

Figures 6, 6A:
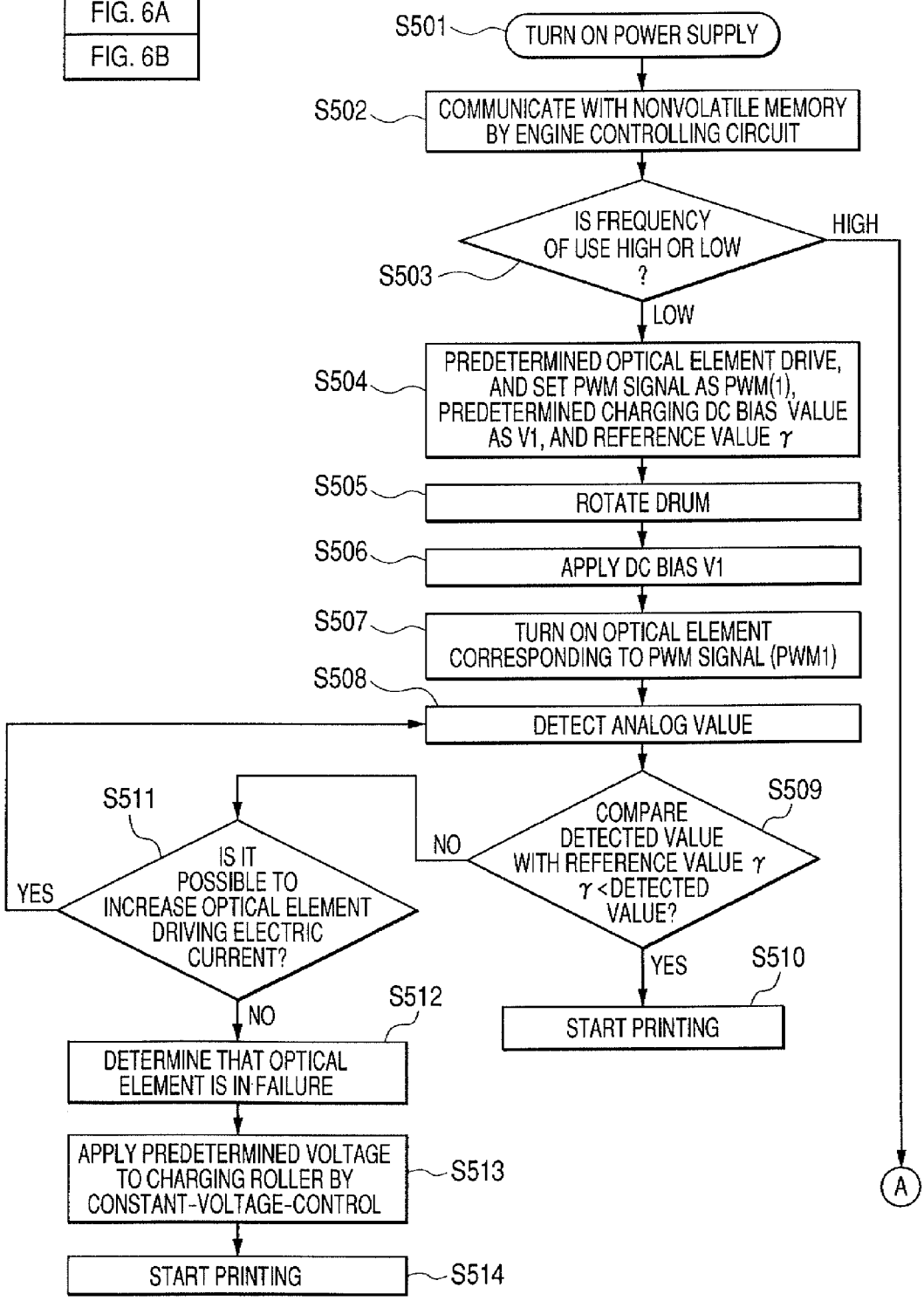
FIG. 6 is comprised of FIGS. 6A and 6B showing flowcharts according to the third embodiment of the present invention.
Figure 6B:
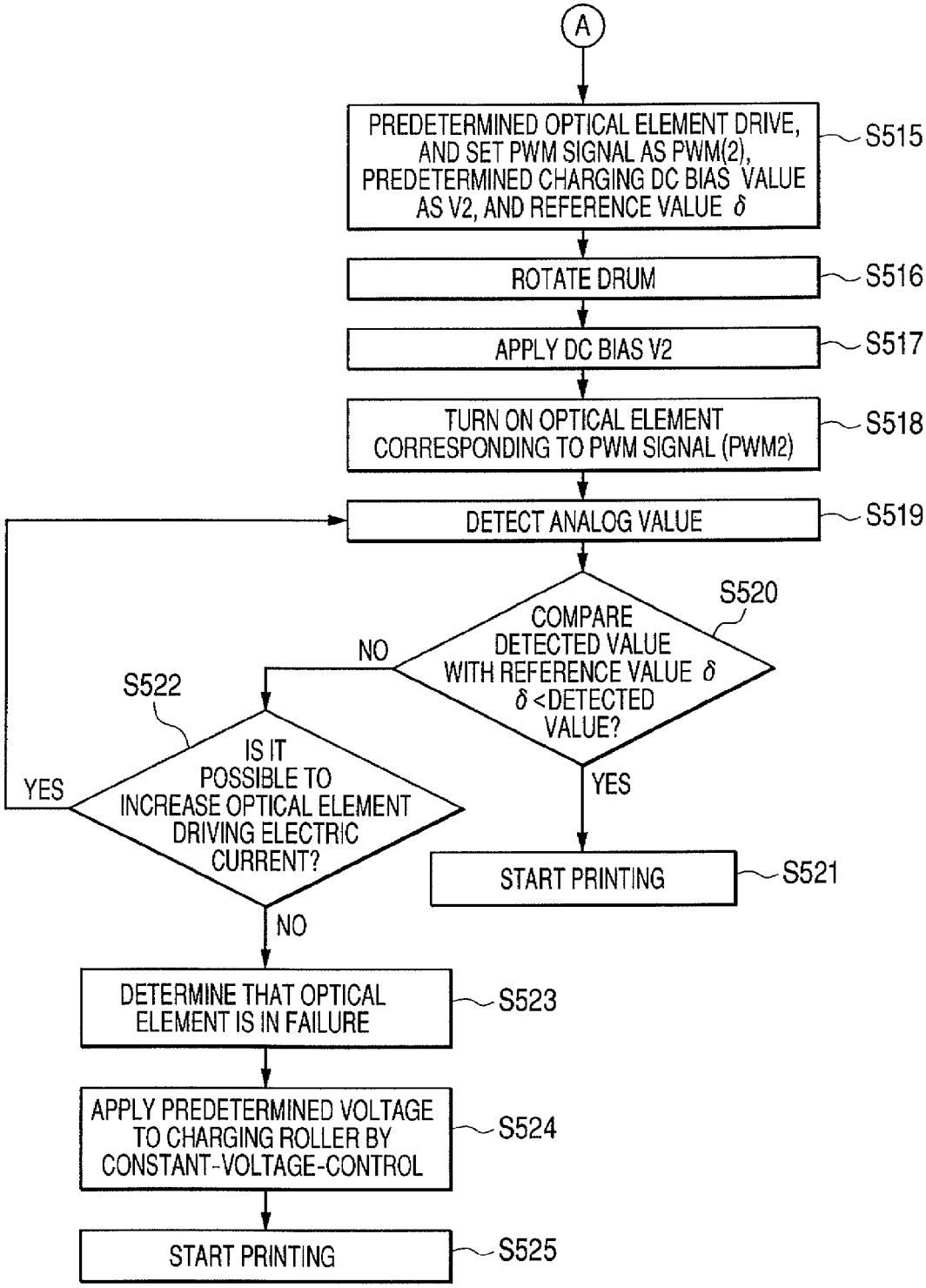

Flowcharts according to this embodiment are shown in FIGS. 6A and 6B.

A power supply of an image forming apparatus is turned on (S501). The control circuit communicates with the nonvolatile memory to confirm the used amount of CRG (S502). Then, based on information of the used amount thereof, selected are a predetermined voltage to be applied to the charging roller, a predetermined driving electric current causing the optical element to emit light, or a reference value with which the state of the optical element is determined as described below (S503). When the used amount is determined to be small, a predetermined voltage to be applied to the charging roller is set to be V1, a predetermined driving electric current causing the optical element to emit light is set to be a driving signal PWM1, or a reference value with which the state of the optical element is determined is set to be a reference value γ (S504). When the photosensitive drum starts to rotate (S505), the optical element is turned on, and a DC bias is applied by constant-voltage-control to the charging roller in the charge eliminating operation area of the photosensitive drum (S506) (S507). In this state, the value of an electric current passing through the charging roller is detected from an analog value of J501 (S508). The detected value thereof is compared with the reference value γ (S509). In the case where the reference value γ<a detected value, sufficient charge elimination is performed, the optical element is determined to have no problem, and then a series of printing operations is started (S510). When the reference value γ≧a detected value, sufficient charge elimination is not performed, and thus the optical element is determined to be deteriorated or contaminated. Subsequently, with a PWM signal for setting a driving electric current of the optical element, the driving electric current is increased, and thus the amount of light of the optical element is increased (S511). Then, an analog value of J501 is calculated again, and the same routine is repeated to a level at which sufficient charge elimination is made. In this routine operation, the driving electric current having been set at a time point of exceeding the reference value γ is recorded and set to be the driving electric current of the optical element for printing, and then printing operation is started (S510). In the case of not exceeding the reference value γ even if the maximum driving electric current is set in this routine operation, the optical element is determined to be in failure (S512). In the charging bias application circuit, the voltage which does not cause poor imaging is set to be applied to the charging roller by constant-voltage-control (S513), and then printing operation is started (S514).

Subsequently, when the used amount is determined to be large in (S503), a predetermined voltage to be applied to the charging roller is set to be V2, a predetermined driving electric current causing the optical element to emit light is set to be a driving signal PWM2, or a reference value with which the state of the optical element is determined is set to be a reference value δ (S515). Moreover, according to this embodiment, V2>V1, PWM2>PWM1, and the reference value δ>the reference value γ (in respective inequalities, comparison of absolute values is made). Then, the following operations are made under the same control as in the case where the used amount is determined to be small. That is, when the photosensitive drum is in rotation, the above-mentioned biases having been set are applied to the charging roller and the optical element (S517) (S518). The value of an electric current passing through the charging roller on that occasion is detected to be a detected value (S519). The detected value is compared with the reference value δ (S520), the routine operation is repeated until a sufficient amount of light of the optical element is obtained (S522), and then printing operation is started (S521).

When the optical element is determined to be in failure (S523), in the charging bias application circuit, the voltage which does not cause poor imaging is set to be applied to the charging roller 106 by constant-voltage-control (S524). Then, the printing operation is started (S525).

By making such control, a charging control based on the used amount of a process cartridge and the operation state of an optical element can be made. Whereby, good charging can be made, and thus images of high quality can be formed.

Furthermore, a process cartridge includes a nonvolatile memory acting as a storage medium. In this memory, values of a driving electric current to be applied to an optical element and values of a voltage to be applied to a charging roller based on situations of use of the process cartridge are stored. By such arrangement, even when another process cartridge is mounted onto the main body of an image forming apparatus, setting based on situations of use of each process cartridge can be made.

In addition, according to the first to third embodiments, although an optical element making exposure of a photosensitive drum is employed as a charge eliminating device, it is not limited thereto. Insofar as the electric charge on the surface of a photosensitive drum can be eliminated, e.g., brush using a conductive fiber may be employed.

Furthermore, in the case of using an optical element as a charge eliminating device, constant-current-control effects less fluctuations in the amount of light than those under constant-voltage-control, to be favorable.

Figure 10:
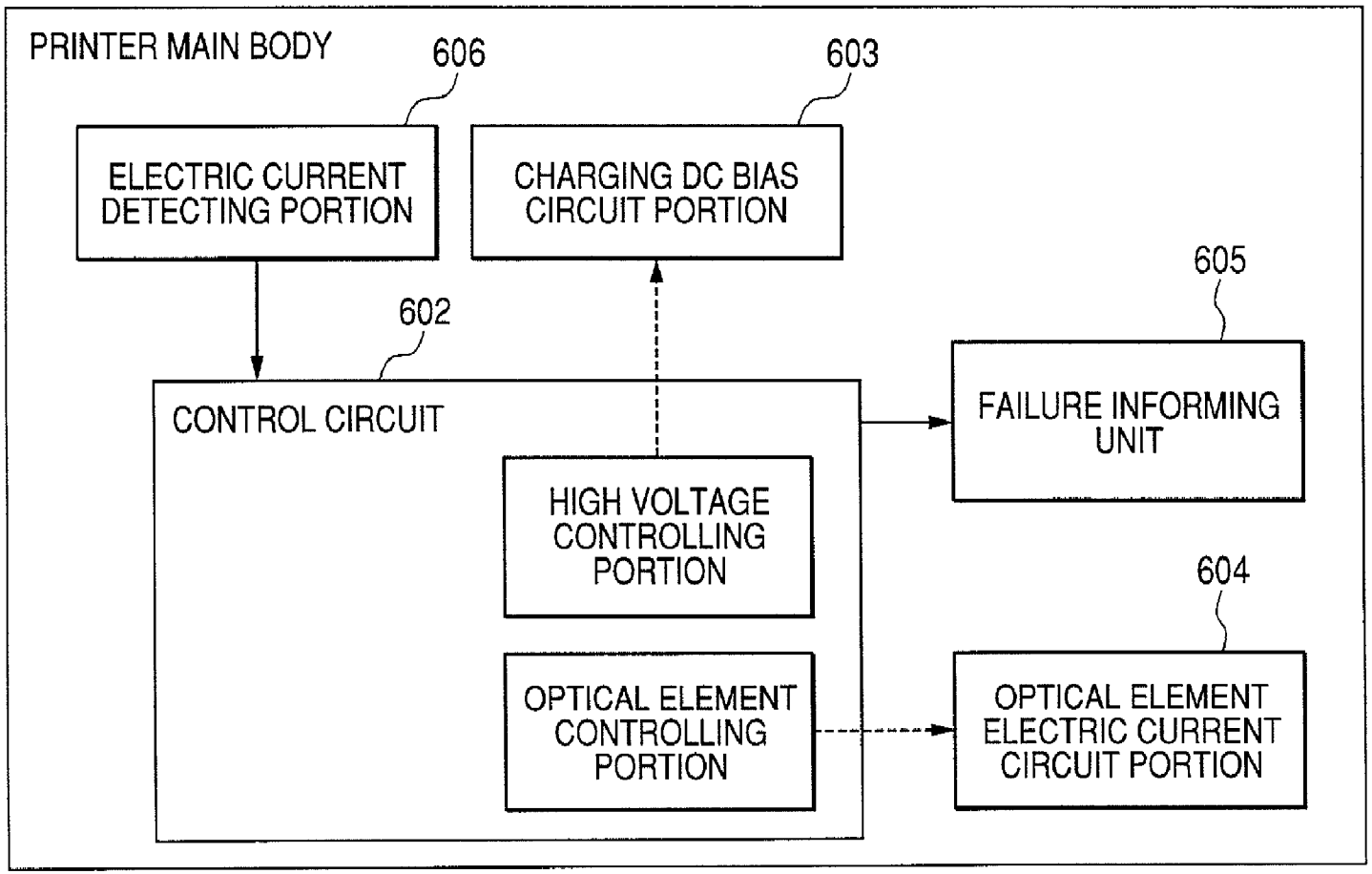
FIG. 10 is a schematic diagram of a failure informing unit according to the present invention.

Moreover, according to this exemplary embodiment, when a charge eliminating device is determined to be in failure, a charging bias is controlled to switch from by constant-current-control to by constant-voltage-control. As an alternative, as illustrated in FIG. 10, an image forming apparatus may be constructed to be provided with a failure informing unit 605 informing failure to the outside when a charge eliminating device is determined to be in failure. As a failure informing unit, indicating the presence of failure on a display panel of an image forming apparatus, sounding an alarm or the like. Furthermore, in the case of the occurrence of failures, it may be thought that e.g., an image forming operation is forced to end to suppress the occurrence of poor imaging.

This application claims the benefit of Japanese Patent Application No. 2006-062531, filed Mar. 8, 2006, and Japanese Patent Application No. 2007-044007, filed Feb. 23, 2007, which are hereby incorporated by reference herein in their entirety.

The invention claimed is:

1. An image forming apparatus comprising:

a rotatable image bearing member;

a charge eliminating device eliminating an electric charge of the image bearing member;

a charging member disposed on a downstream side of the charge eliminating device in a rotation direction of the image bearing member, and charging the image bearing member, the charging member charging a charge eliminating operation area of the image bearing member where the charge eliminating device is operated;

an electric current detecting portion detecting an electric current passing through the charging member, wherein at a time of non-image formation, a voltage is applied to the charging member in the charge eliminating operation area to detect a value of an electric current passing through the charging member by the electric current detecting portion; and a control portion, which switches, based on the electric current value, between a constant-current-control and a constant-voltage-control of the voltage to be applied to the charging member at a time of image formation wherein when the electric current value is not more than a first value, the control portion performs the constant-voltage-control of the voltage to be applied to the charging member at the time of image formation, and wherein when the electric current value is more than the first value, the control portion performs the constant-current-control of the voltage to be applied to the charging member at the time of image formation.

2. An image forming apparatus according to claim 1, wherein when the electric current value is more than the first value and not more than a second value, the control portion performs a control of applying a first bias to the charge eliminating device, and wherein when the electric current value is more than the second value, the control portion performs a control of applying a second bias smaller than the first bias to the charge eliminating device.

3. An image forming apparatus according to claim 1, wherein the charge eliminating device is an optical element, and an electric current passing through the optical element is constant-current-controlled.

4. An image forming apparatus according to claim 1, wherein a process cartridge provided with at least the image bearing member is detachably mountable to a main body of the image forming apparatus, and wherein a bias value to be applied to the charge eliminating device for forming the charge eliminating operation area and the voltage to be applied to the charging member in the charge eliminating operation area at the time of non-image formation are changed based on a use state of the process cartridge.

5. An image forming apparatus according to claim 4, wherein the process cartridge includes a storage medium, and the storage medium stores the bias value to be applied to the charge eliminating device and the voltage to be applied to the charging member that are changed based on the use state of the process cartridge.

* * * * *